US005865981A

United States Patent [19]

de Nora

[11] Patent Number: 5,865,981

[45] **Date of Patent: *Feb. 2, 1999**

[54] ALUMINIUM-IMMERSED ASSEMBLY AND METHOD FOR ALUMINIUM PRODUCTION CELLS

[75] Inventor: Vittorio de Nora, Nassau, Bahamas

[73] Assignee: Moltech Invent S.A., Luxembourg, Luxembourg

[ * ] Notice: The term of this patent shall not extend beyond the expiration date of Pat. No. 5,472,578.

[21] Appl. No.: 809,131

[22] PCT Filed: Aug. 30, 1995

[86] PCT No.: PCT/IB95/00718

§ 371 Date: Mar. 14, 1997

§ 102(e) Date: Mar. 14, 1997

[87] PCT Pub. No.: WO96/08590

PCT Pub. Date: Mar. 21, 1996

[30] Foreign Application Priority Data

Aug. 30, 1995 [WO] WIPO ..... PCT/IB95/00748

[51] Int. Cl.[6] ..... C25C 3/08

[52] U.S. Cl. ..... 205/372; 205/381; 205/384; 204/243 R; 204/284; 204/290 R; 204/294

[58] Field of Search ..... 204/243 R–247, 204/284, 290 R, 294; 205/372, 380–381, 384

[56] References Cited

U.S. PATENT DOCUMENTS

| | | | |
|---|---|---|---|
| 3,856,650 | 12/1974 | Kugler et al. . | |
| 4,243,502 | 1/1981 | Kugler . | |
| 4,297,180 | 10/1981 | Foster, Jr. . | |
| 4,349,427 | 9/1982 | Goodnow et al. . | |
| 4,376,690 | 3/1983 | Kugler . | |
| 4,410,412 | 10/1983 | Kugler . | |
| 4,443,313 | 4/1984 | Gesing et al. . | |
| 4,460,440 | 7/1984 | McGeer . | |
| 4,462,886 | 7/1984 | Kugler . | |
| 4,526,669 | 7/1985 | Joó et al. . | |
| 4,532,017 | 7/1985 | Keinborg et al. . | |
| 4,533,452 | 8/1985 | Leroy et al. . | |
| 4,544,457 | 10/1985 | Sane et al. . | |
| 4,824,531 | 4/1989 | Duruz et al. . | |
| 4,919,782 | 4/1990 | Stewart | 204/243 R |
| 5,129,998 | 7/1992 | Tabereaux et al. | 204/243 R X |
| 5,286,359 | 2/1994 | Richards et al. | 204/243 R |
| 5,310,476 | 5/1994 | Sekhar et al. . | |
| 5,340,448 | 8/1994 | Sekhar et al. . | |
| 5,362,366 | 11/1994 | de Nora et al. . | |
| 5,364,513 | 11/1994 | Sekhar et al. . | |

FOREIGN PATENT DOCUMENTS

| | | |
|---|---|---|
| 9325731 | 12/1993 | WIPO . |

*Primary Examiner*—Donald R. Valentine
*Attorney, Agent, or Firm*—Dinsmore & Shohl

[57] ABSTRACT

A cell for the production of aluminium by the electrolysis of a molten electrolyte, in particular the electrolysis of alumina dissolved in a molten fluoride-based electrolyte such as cryolite, comprises anodes immersed in the molten electrolyte above a cell bottom whereon molten product aluminium is collected in a pool containing bodies of aluminium-resistant material. Under the anodes are corresponding grids made of side-by-side upright or included walls aluminium-resistant material whose bottom ends stand on a ceramic-coated carbon cell bottom covered by the pool molten aluminium. The bottom ends of the grid walls form a base which is large compared to the height of the walls. Each grid on the cell bottom in stable manner during the operation of the cell and is easily removable from the cell and insertable in the cell. Each grid has generally vertical through-openings to allow the molten cell content to occupy the inside of the through-openings are in communication with the molten aluminium in the pool or layer so that the molten aluminium occupies at least a part of the height of the openings. These grids reduce movements in the aluminium pool and their top parts may act as a drained cathode.

23 Claims, 4 Drawing Sheets

Fig. 2a
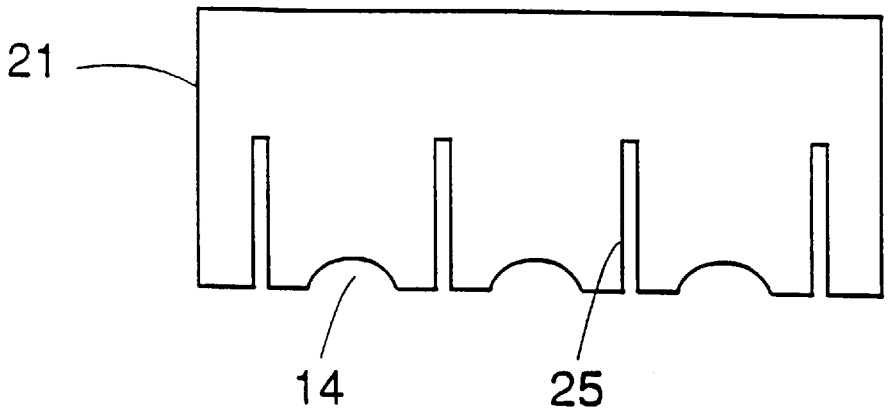
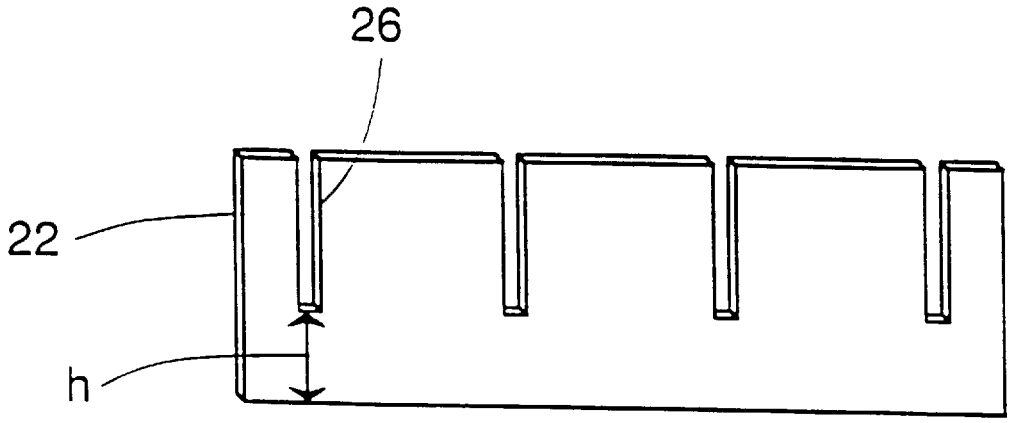
Fig. 2b

ALUMINIUM-IMMERSED ASSEMBLY AND METHOD FOR ALUMINIUM PRODUCTION CELLS

FIELD OF THE INVENTION

The invention relates to cells for the production of aluminium by the electrolysis of a molten electrolyte, in particular the electrolysis of alumina dissolved in a molten fluoride-based electrolyte such as cryolite, comprising anodes immersed in the molten electrolyte above a cell bottom whereon molten product aluminium is collected in a pool or layer which contains bodies of aluminium-resistant material.

BACKGROUND OF THE INVENTION

Aluminium is produced conventionally by the Hall-Héroult process, by the electrolysis of alumina dissolved in cryolite-based molten electrolytes at temperatures up to around 950° C. A Hall-Héroult reduction cell typically has a steel shell provided with an insulating lining of refractory material, which in turn has a lining of carbon which contacts the molten constituents. Conductor bars connected to the negative pole of a direct current source are embedded in the carbon cathode forming the cell bottom floor. The cathode is usually an anthracite or graphite based carbon lining made of prebaked cathode blocks, joined with a ramming mixture or glue.

In Hall-Héroult cells, a molten aluminium pool acts as the cathode surface. The carbon bottom lining or cathode material has a useful life of three to eight years, or even less under adverse conditions. The deterioration of the cathode bottom is due to erosion and penetration of electrolyte and liquid aluminium as well as penetration of sodium into the carbon, which by chemical reaction and intercalation causes swelling, deformation and disintegration of the cathode carbon blocks and ramming mix. In addition, the penetration of sodium species and other ingredients of cryolite or air leads to the formation of toxic compounds including cyanides.

Difficulties in operation also arise from the accumulation of undissolved alumina sludge on the surface of the carbon cathode beneath the aluminium pool which forms insulating regions on the cell bottom. Penetration of cryolite and aluminium through the carbon body and the deformation of the cathode carbon blocks also cause displacement of such cathode blocks. Due to displacement of the cathode blocks and the formation of cracks, aluminium reaches the steel cathode conductor bars causing corrosion thereof leading to deterioration of the electrical contact, non uniformity in current distribution and an excessive iron content in the aluminium metal produced.

Extensive research has been carried out with Refractory Hard Metals (RHM) such as $TiB_2$ as cathode materials. $TiB_2$ and other RHM's are practically insoluble in aluminium, have a low electrical resistance, and are wetted by aluminium. This should allow aluminium to be electrolytically deposited directly on an RHM cathode surface, and should avoid the necessity for a deep aluminium pool.

Because titanium diboride and similar Refractory Hard Metals are wettable by aluminium, resistant to the corrosive environment of an aluminium production cell, and are good electrical conductors, numerous cell designs utilizing Refractory Hard Metal have been proposed, which would present many advantages, notably including the saving of energy by reducing the anode-cathode distance (ACD).

U.S. Pat. No. 3,856,650 proposed lining a carbon cell bottom with a ceramic coating upon which parallel rows of tiles are placed, in the molten aluminium, and spaced apart from one another by expansion gaps in a grating-like arrangement. The purpose of this "grating" was to protect the ceramic coating against mechanical effects due, for example, to movements of the aluminium pool.

U.S. Pat. No. 4,243,502 described designs for aluminium-wettable cathodes some of which had a generally horizontal active surface supported by one or more supporting plates, usually connected to a current supply by an extension protruding from the top of the electrolyte, between the anodes. Such designs were not practicable.

U.S. Pat. No. 4,410,412 described wettable cathodes made of aluminide materials. These cathodes were supposed to be exchangeable, by holding several cathode elements together in a holder of insoluble refractory material. Special cell designs to make use of such aluminides were also described in U.S. Pat. No. 4,462,886. Again, such materials and designs did not prove to be practicable.

PCT patent application W083/04271 proposed cathodic elements of refractory hard materials such as titanium diboride in the shape of mushrooms having relatively large flat tops facing the anode in order to maximize the active cathode surface. However, no adequate means could be found for connecting the mushroom stems to the cell bottoms, so this design also failed.

To accommodate for fluctuations in the level of the pool of aluminium, European patent EP-B-0 082 096 proposed the use of floating cathode elements made of titanium diboride combined with a lighter material to reduce its density, for instance graphite. These floating elements were restrained by elements connected to the cell bottom, leading to an impractical design.

EP-A-0 103 350 proposed the use of tubular cathode elements, for example of titanium diboride, which rest on the cell bottom dipping in a shallow aluminium pool. The inner diameter of the elements was such as to maintain molten aluminium up to near the tops of the tubes by capillary action. These individual tubes were distributed over the cell bottom with a suitable spacing, and were to remain on the cell bottom during use.

U.S. Pat. No. 4,349,427 has proposed replaceable modular cathode assemblies in the form of a table on which free shapes of refractory material are packed.

To restrict movement in a "deep" cathodic pool of molten aluminium, U.S. Pat. No. 4,824,531 proposed filling the cell bottom with a packed bed of loose pieces of refractory material. Such a design has many potential advantages but, because of the risk of forming a sludge by detachment of particles from the packed bed, the design has not found acceptance.

U.S. Pat. No. 4,443,313 sought to avoid the disadvantages of the previously mentioned loose packed bed by providing a monolayer of closely packed small ceramic shapes such as balls, tubes or honeycomb tiles having uniform, small apertures that restrain the entry of sludge.

Despite extensive efforts and the potential advantages of having surfaces of titanium diboride at the cell cathode bottom, such propositions have not been commercially adopted by the aluminium industry.

Recently, a number of proposals have been made for the feasible, low-cost production of various composite materials containing or coated with titanium diboride or other refractory ceramic materials, enabling promising applications in many of the already-proposed cell designs.

For instance, WO 93/20027 discloses forming protective refractory coatings on a conductive substrate like carbon starting from a micropyretic reaction layer from a slurry containing reactants in a colloidal carrier. WO 93/20026 discloses protective coatings applied from a colloidal slurry containing particulate reactant or non-reactant substances. WO 93/25731 more particularly describes the application of pre-formed refractory borides in a colloidal carrier to carbon cell components of aluminium production cells.

Such coating materials have in particular enabled substantial improvements in the conventional cell bottom designs. However, it has turned out that many of the heretofore proposed "new" cell designs are unsatisfactory in one or more respects, even with materials that stand up in the environment.

OBJECTS OF THE INVENTION

One object of the invention is to provide a cell in which the anode-cathode distance ACD can be made small due to there being only small ripples or no ripples on the surface of the aluminium pool, or due to there being a drained cathode configuration.

Another object of the invention is to provide means which reduce or eliminate horizontal movement of the aluminium pool which would erode the cathode and reduce current efficiency, redissolving the metal in the bath.

A further object of the invention is to provide, in the aluminium pool, bodies of a material of low resistivity which make good contact with the cathode cell bottom, permitting a low voltage drop between the cathode cell bottom and the active cathode surface even with sludge formation.

Another object of the invention is to provide means which permit operation of the cell with a shallow aluminium pool or layer and which provide a better and more uniform current distribution.

Yet another object of the invention is to provide bodies for stabilizing the aluminium pool, which bodies are mechanically strong, easy to place on the cell bottom, remain firmly in place during operation, can withstand the cell conditions for long periods of time without disintegrating and unwantedly depositing sludge on the cell bottom, and remain mechanically strong even after long periods of service and can be lifted from the cell for servicing or replacement.

A further object of the invention is to provide a cell whose operation costs can be reduced considerably, whose aluminium inventory can be much smaller than in conventional cells if desired and wherein, even when the cell is operated with a deep pool of molten aluminium, magnetohydrodynamic effects are reduced.

SUMMARY OF THE INVENTION

In its main aspect, the invention provides a cell for the production of aluminium by the electrolysis of a molten electrolyte, in particular the electrolysis of alumina dissolved in a molten fluoride-based electrolyte such as cryolite, comprising a plurality of anodes immersed in the molten electrolyte above a cell bottom whereon molten product aluminium is collected in a pool or layer containing bodies made of or coated with aluminium-resistant material.

According to the invention, the anodes are associated with a number of corresponding bodies each formed by a grid assembly (called a grid) of side-by-side upright or inclined walls of aluminium-resistant material, the walls of each assembly having top ends placed under the anode and bottom ends standing on the cell bottom covered by the pool or layer of molten aluminium. The bottom ends of the walls form a base which is large compared to the height of the walls so that the grid assembly when resting on its base is stable, each such grid assembly standing on the cell bottom in stable manner during operation of the cell and being easily removable from the cell and insertable in the cell. Each grid assembly has generally vertical through-openings dimensioned to allow the molten cell content (electrolyte, molten aluminium and sludge, where present) to pass into the through-openings and remain inside. These vertical through-openings are in communication with the molten aluminium in the pool or layer so that the molten aluminium occupies at least a part of the height of these openings.

In some embodiments at least part of the walls of the grid assembly are made of electrically conductive material. In other embodiments where the grid assembly remains immersed, at least part of the walls of the grid assembly are made of material of high electrical resistivity. All or part of the walls of the grid structures may be made of or coated with an aluminium wettable material in particular a refractory boride such as titanium diboride and/or may be made of or coated or impregnated with a cryolite resistant material. When the walls protrude outside the molten aluminium to form an active cathode surface they must be made of electrically conductive material which is cryolite resistant and aluminium-wettable or is suitably coated to provide these properties.

The walls of each grid assembly may have aluminium-wettable top parts which protrude above the molten product aluminium, thereby forming drained cathode surfaces facing the associated anode.

In some drained-cathode embodiments, the protruding top parts of the grid walls forming drained cathode surfaces are inclined, facing corresponding inclined surfaces of the anodes, thereby facilitating gas release and promoting uniform wear of the anodes when they are formed of pre-baked carbon bodies, it however being understood that dimensionally stable non-carbon anodes will usually be preferred.

Alternatively, the grids may remain totally immersed in the pool of molten aluminium with a stabilized surface layer of molten aluminium over the tops of the grid walls.

The cell bottom is advantageously made of carbon or a carbon-based material, having a surface layer of electrically-conductive RHM-containing material on which the grids stand. Such a layer is of paramount importance because it protects the underlying carbon cathode from sodium penetration and avoids deformations of the cell bottom which would make the grid unstable. Advantageously, such coating material is of the type disclosed in WO 93/25731.

The walls of the grids are usually vertical to the plane of the grid base, but some or all of the walls can be inclined by an angle up to 30° to the vertical from the plane of the grid base, for instance inclined up to 15° to vertical so the top of the assembly is smaller than the base.

In one advantageous embodiment, the grids are formed by a series of plates intersecting one another, preferably at right angles, the intersecting plates defining a series of generally vertical openings through the assembly, the intersecting plates usually having end parts protruding from the outer faces of the two outermost plates with which they intersect. Such intersecting plates provide a mechanically strong grid, which can be assembled to any desired shape and size, and whose height is usually much less than the width and length, so when the grid is placed on the cell bottom it will remain stable.

Other grid assemblies may be formed by tubular pieces joined together side-by-side, in which case the tubular pieces define a series of generally vertical openings through the assembly, these openings being provided inside the tubular pieces and possibly also between the tubular pieces. These tubular pieces may have any desired cross-sectional shape such as round, square, rectangular, hexagonal etc.

The grid assemblies could also be formed by profiled sections assembled side-by-side to define a series of generally vertical openings through the assembly.

It is also possible to make a grid from a series of plates held in spaced-apart parallel configuration by transverse securing members such as cross-bars.

The bottom ends of the walls may be spaced above the cell bottom or have apertures allowing passage of molten aluminium on the cell bottom within the lower end part of the grid assembly between the bottom parts of the walls forming the grid assembly. In one embodiment the top parts of at least some of the walls of the grid assembly have recesses serving as guides which receive the lower ends of anode plates suspended above the grid assembly. In this arrangement, advantageously other walls of the grid assembly intersect with said recessed walls, and are made of electrically-conductive material, these other walls protruding above the molten product aluminium. The parts of the walls which protrude above the molten product alumina are made of or coated with aluminium-wettable material.

The assemblies according to the invention, particularly grids made of intersecting walls, are mechanically strong, easy to place on the cell bottom, and remain firmly in place during operation. They can withstand the cell conditions for long periods of time without disintegrating, and remain mechanically strong even after long periods of service and can be lifted from the cell for servicing or replacement.

The invention also encompasses use of such cells for the production of aluminium by the electrolysis of alumina dissolved in a molten halide electrolyte such as cryolite, where the grids serve to restrain movements in the pool of molten aluminium, and wherein during operation the grids (or other assemblies) are removed periodically or when necessary for servicing or replacement, and new or serviced grids are replaced in the cell.

Operation of the cell is advantageously in a low temperature process, with the molten halide electrolyte containing dissolved alumina at a temperature below 900° C., usually at a temperature from 680° C. to 880° C. The low temperature electrolyte may be a fluoride melt or a mixed fluoride-chloride melt. This low temperature process is operated at low current densities on account of the low alumina solubility.

However, the invention is particularly advantageous also in conventional cell designs where the carbon blocks are assembled to form the cell bottom, preferably with the inclusion of a refractory coating on the conventional cathode surface to support the grids. Existing cells can thus be retrofitted by inserting these grids on a coated carbon bottom.

BRIEF DESCRIPTION OF THE DRAWINGS

Preferred embodiments of the invention will be further described by way of example, with reference to the accompanying schematic drawings, in which:

FIGS. 2*a* and 2*b* are side views of plates which can be assembled together, or with other similar plates, or with plates of different shapes to form a grid according to the invention;

DETAILED DESCRIPTION OF PREFERRED EMBODIMENTS

Figure 1:
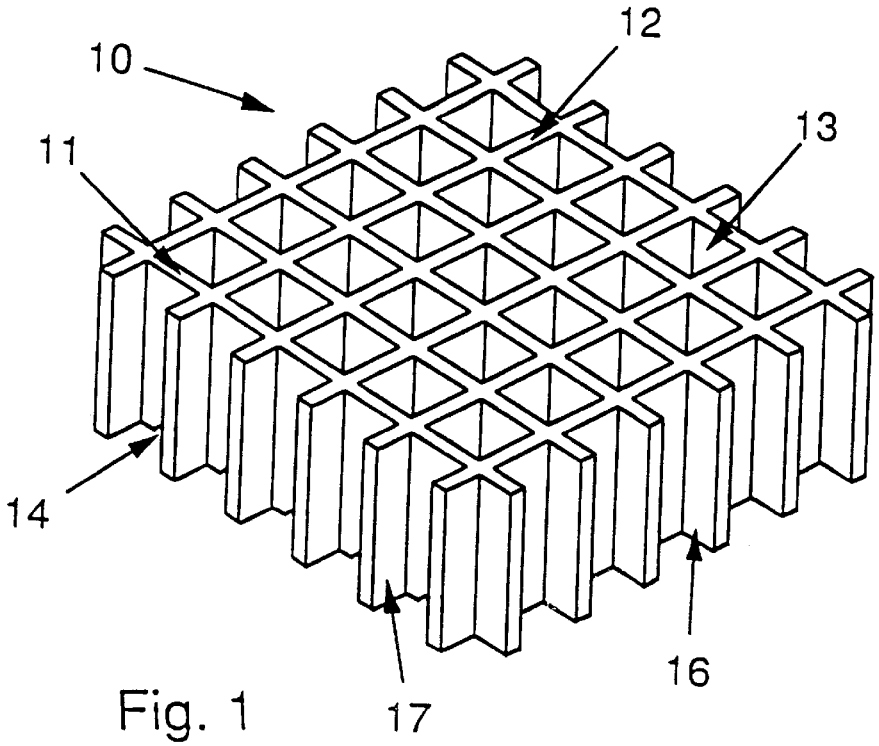
FIG. 1 is a perspective view of one example of a grid according to the invention.

FIG. 1 shows a grid 10 made by assembling together a series of plates 11 and 12 at right angles to form a rectangular body having rows of side-by-side vertical through-openings 13 opening into the top and bottom surfaces. In their bottom edges, some of the plates have apertures 14 of suitable size and shape to allow molten aluminium to penetrate inside the grid and fill the bottom part of the openings 13 when the grid 10 is placed on the cell bottom of an aluminium production cell. As shown, the plates 11 and 12 have protruding end parts 16 and 17 respectively which extend beyond the outermost plates with which they intersect.

The height of grid 10 is small compared to the size of its base formed by the bottom ends of plates 11 and 12, so that the grid is stable when placed on its base. As illustrated, the height is about ⅓ the width and length of the grid and usually it will be much less, for instance ⅒th or less. At the other extreme, the height will not be less than the shortest side dimension, usually no more than one half the shortest side dimension. These dimensions will of course be chosen as a function of the cell configuration in which the grids are to be used.

By way of example, FIG. 1 shows six plates 11 intersecting at 90° with six plates 12. Any suitable number of plates may be chosen. The vertical through-openings 13 may be of square or rectangular cross-section, or lozenge-shaped. Usually the lengths of plates 11 and 12 will be selected so that the grid 10 corresponds at least approximately in size to an anode of the aluminium production cell below which the grid will be placed. However, it is possible to place two or more cathode grids 10 according to the invention under one anode, or a single cathode grid 10 under several anodes, for example under two anodes arranged side-by-side in a cell, or under several anodes aligned lengthwise along a cell.

Generally speaking, a cell with a given number of n anodes will have an equal number of n corresponding grids, or a number of corresponding grids which is a whole number multiple of n (typically 2n grids or possibly 4n grids), or a number of corresponding grids which is a whole number fraction of n (typically n/2 grids where n is an even number or possibly n/4 grids where n is a multiple of 4).

The plates 11 and 12 are made of a material resisting the conditions encountered in an aluminium production cell, in particular the materials should be resistant to molten aluminium and preferably also to the cryolite or other molten halide electrolyte. The outer surface at least of the plates 11 and 12 will preferably be made of a material wettable by molten aluminium, such as titanium diboride or another aluminium-wettable refractory material including composite materials based on titanium diboride and other refractory borides. Such refractory borides are dense materials, which means that the grid 10 has a density such that it will settle on the cell bottom and remain stable on the cell bottom during normal cell operation.

If however the plates 11 and 12 are made of a less-dense material such as a composite formed of carbon or a carbon based material coated with refractory boride, it may be necessary to include an internal ballast in the walls 11, 12, for instance inner steel inserts. Or it is possible to fill one or more of the openings 13 entirely or partly with a suitable dense material. Alternatively, it would be possible to provide means for holding the grids on the cell bottom, allowing the grids to be removed when necessary.

Examples of walls 21, 22 are shown in FIGS. 2*a* and 2*b*. Wall 21 of FIG. 2*a* has slots 25 in one of its long edges. Apertures 14 are provided between the ends of slots 25 in its edge which will rest on the cell bottom. Several of these walls 21 arranged parallel to one another can be assembled by fitting similar walls, disposed transversely, by interengagement of their slots 25, i.e. with the transverse walls placed upside down in relation to FIG. 2*a*. The top edges of the transverse walls preferably do not have recesses like the apertures 14.

FIG. 2*b* shows a wall 22 with slots 26 in its upper edge for receiving transverse plates which may be held above the cell bottom by a height h, thus allowing for circulation of the aluminium pool.

The grid 10 can rest directly on the cell bottom with the bottom edges of its plates 11, 12 on the cell bottoms, in which case apertures such as apertures 14 are provided in the bottom edges to allow the molten aluminium to freely penetrate into the openings 13 within the grid, or it is possible for the grid 10 to be fitted with feet on which it stands, or the grid 10 may rest on beams or walls extending across the cell bottom and which allow a space for molten aluminium to penetrate in the bottom of the grid 10.

The intersecting walls can be held together solely by a tight fit of the interengaging slots, or they can be welded together or secured by any suitable means. It is also possible to make each grid with intersecting walls as a single piece.

Figure 3:
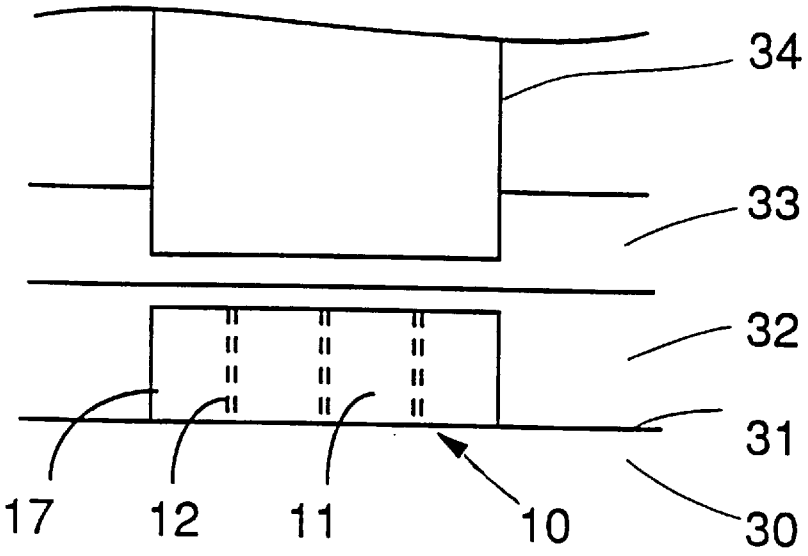
FIG. 3 is a partial view of an electrolytic aluminium production cell with an anode above a grid according to the invention.

With reference to FIG. 3, a grid 10 of the invention, made of walls 11 and 12, is illustrated on a cell bottom 30 of an aluminium production cell, shown only in part. The cell bottom 30 is for instance made of carbon and is coated with a refractory coating 31, for example a titanium diboride based coating as described in WO 93/20026. Such coating prevents sodium penetration in the carbon cell bottom 30 and, most important, prevents deformation of the cell bottom 30. Also, particularly in the areas of the cell bottom 30 outside the grids 10, such coating improves the resistance of the cell bottom to wear by movements of sludge.

In this example, the grid 10 is immersed in the cathodic pool of molten aluminium 32, and normally remains permanently below the surface of the molten aluminium 32 and therefore does not normally contact the molten cryolite or other molten fluoride-based electrolyte 33. Above the grid 10, an anode 34 dips into the molten electrolyte 33. As shown, the grid 10 may be about the same size as the facing anode 34, but it could be somewhat smaller or larger, and may be of the same or different shape in plan view.

In this embodiment, the grid 10 serves to restrain movements in the pool of molten aluminium 32. By stabilizing the pool 32, ripples on the surface are minimized and the anode-cathode interelectrode space can be maintained at a small and approximately constant value, using standard consumable pre-baked carbon anodes or, preferably, using dimensionally stable anodes.

The required number of grids 10 can be installed in place on the cell bottom 30 when starting up the cell as the cell contents melt, or during operation while the cell contents are already molten.

The described grids 10 made of intersecting walls are mechanically strong, easy to place on the cell bottom 30, remain firmly in place during operation, and can withstand the cell conditions for long periods of time without disintegrating. Such grids remain mechanically strong even after long periods of service, and they can without great difficulty be lifted from the cell during operation for servicing or replacement.

Figure 4:
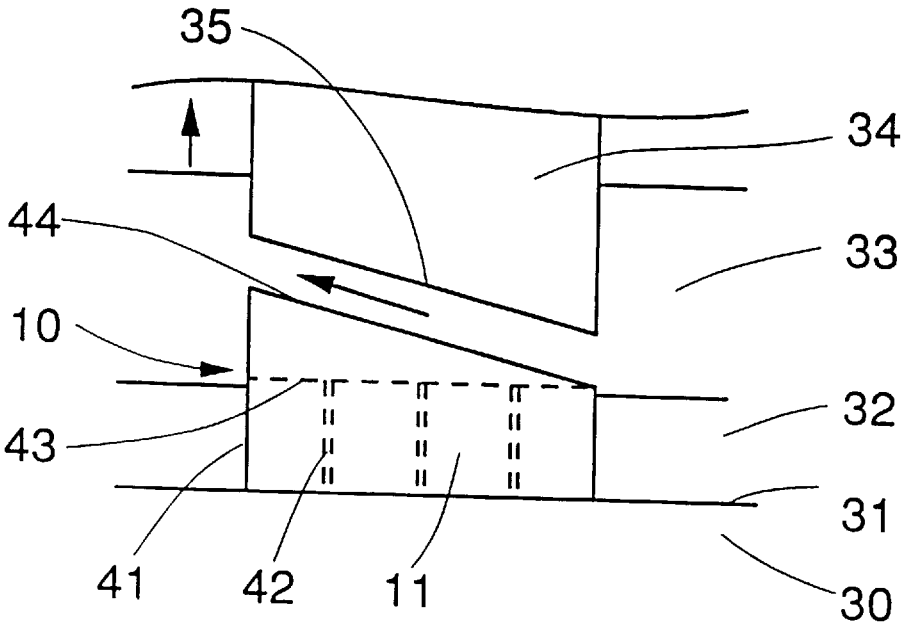
FIG. 4 is another partial view of an electrolytic aluminium production cell with an anode having a downwardly-facing sloping surface cooperating with inclined top parts of a cathode-forming grid according to the invention.

FIG. 4 shows another embodiment with a grid 10 having inclined top cathode-forming edges 44 which face a corresponding inclined lower face 35 of anode 34. This grid 10 comprises trapezoidal plates 41 each having a rectangular bottom part and an inclined top edge 44. Transverse walls 42 may extend to height 43, just above, at the same level as, or below the usual level of the surface of aluminium pool 32.

The angle of inclination of the anode face 35, and the cathode-forming edge 44 of grid 10, is usually from about 3° to about 15° from horizontal in order to ensure an effective removal of the anodically-generated gases, as indicated by the arrows, thereby avoiding "bubble effects" on the lower anode face, especially when the anodes 34 are prebaked carbon anodes.

In this embodiment, the inclined top parts 44 of the walls 41 of grid 10 protrude above the top surface of the aluminium pool 32, in the molten electrolyte 33. Thus, these inclined top parts 44 of grid 10 form a drained cathode from which the product aluminium drains into the pool 32 which is stabilized by being held inside the vertical through-openings in grid 10. Movements of the aluminium pool 32 between the grids 10 is also restrained due to the presence of these grids.

Because these top parts 44 of the grids 10 are exposed both to the molten aluminium 32 and the molten electrolyte 33, these parts are subjected to a more aggressive environment than for embodiments where the grid 10 remains under the cathodic aluminium 32. Consequently, the lifetime of such cathode-forming grids is not so great. However, it is relatively easy to monitor wear or degradation of the exposed cathode-forming top parts 44 of the grids, and remove and replace an entire grid 10 when necessary or when desired to optimize cell performance.

Figure 5:
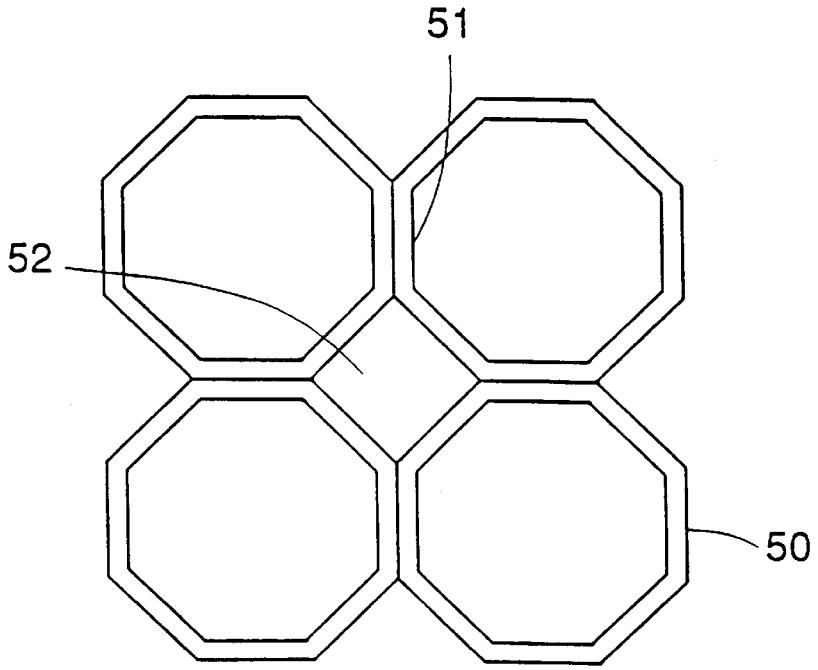
FIG. 5 is a top view of a grid assembly according to the invention with polygonal openings.

FIG. 5 illustrates another type of grid assembly 10 made up of several tubular pieces 50 connected together. The illustrated assembly is made up of a cluster of four octagonal tubular pieces 50 joined together by facing sides 51, leaving a central opening 52 of square section. The facing sides 51 can be secured together, e.g. by welding, or they could have interengaging shapes, or both. The bottom edges of pieces 50 have apertures for passage of molten aluminium. This cluster can be extended by adding on further pairs of tubular pieces in either or both directions to form an assembly of the desired shape and dimensions.

Figure 6:
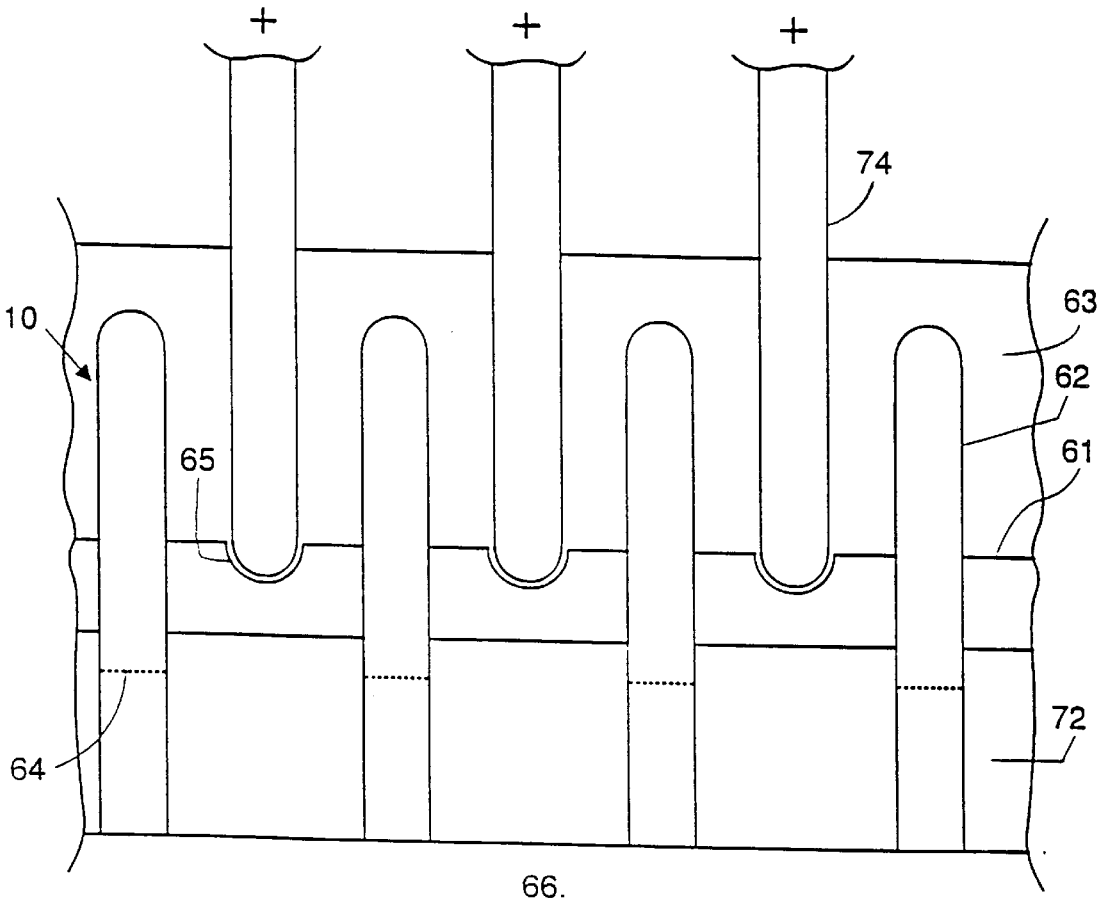
FIG. 6 is a side view of a different grid assembly according to the invention showing how it cooperates with anodes.

FIG. 6 shows another cathode grid 10 cooperating with anode plates. This grid comprises intersecting vertical plates 61 and 62 which rest on a cell bottom 66. The plates 61 are just over half of the height of plates 62. In their lower edges the plates 62 have apertures 64, below the level of a molten aluminium pool 72.

Mid-way between the grid's vertical plates 62, the top edges of plates 61 have recesses 65 serving as guides which receive the lower ends of a series of anode plates 74 suspended parallel to one another by means not shown.

The upper ends of the grid's cathode plates 62 protrude above the aluminium pool 72 into a molten cryolite or other molten fluoride-based electrolyte 63, so that electrolysis can take place between the bottom parts of anode plates 74 and the facing top parts of cathode plates 62. These protruding upper ends of cathode plates 62 are made of or coated with aluminium-wettable material such as titanium diboride.

I claim:

1. A cell for the production of aluminium by the electrolysis of a molten electrolyte, in particular the electrolysis of alumina dissolved in a fluoride-based molten halide electrolyte, comprising a plurality of anodes (34) immersed in the molten electrolyte above a cell bottom (30, 66) whereon molten product aluminium is collected in a pool or layer (32, 72) containing bodies of aluminium-resistant material, characterized in that the anodes (34) are associated with a number of corresponding bodies each formed by a grid assembly (10) of side-by-side upright or inclined walls (11, 12; 21, 22; 41, 42; 51; 61, 62) made of or coated with aluminium-resistant material, the walls of each grid assembly having top ends placed under the anode (34) and bottom ends standing on the cell bottom (30, 66) in the pool or layer (32, 72) of molten aluminium, the bottom ends of the walls forming a base which is much larger than the height of the walls, each grid assembly (10) standing on the cell bottom (30, 66) in stable manner during operation of the cell and being removable from the cell and insertable in the cell, and each grid assembly (10) having generally vertical through-openings (13) dimensioned to allow the molten cell content to occupy the inside of the through-openings, said vertical through-openings (13) being in communication with the molten aluminium in the pool or layer (32, 72) so that the molten aluminium occupies at least a part of the height of said openings (13), said grid assemblies either remaining immersed in the pool (32) of molten aluminium with a stabilized surface layer of molten aluminium over the tops of the walls (11, 12) of each assembly, or protruding above the pool or layer (32) of molten aluminium outside and inside said grid assemblies.

2. The cell of claim 1, wherein at least part of the walls of the grid assembly (10) are made of electrically-conductive material.

3. The cell of claim 2, wherein each grid assembly (10) has walls (41) with top parts (44) having aluminium-wettable surfaces which protrude above the pool or layer (32) of molten product aluminium to form drained cathode surfaces facing the associated anode.

4. The cell of claim 3, wherein the top parts (44) of the walls (41) forming drained cathode surfaces are inclined, facing corresponding inclined surfaces (35) of the anodes.

5. The cell of claim 1, wherein at least part of the walls of the grid assembly (10) are made of material of high electrical resistivity.

6. The cell of claim 1, wherein at least part of the walls of the grid assembly (10) are made of or coated with aluminium wettable material.

7. The cell of claim 1, wherein at least part of the walls of the grid assembly (10) are made of or coated or impregnated with cryolite resistant material.

8. The cell of claim 1, wherein the walls of the grid assemblies (10) are made of material which is wettable by molten aluminium and resistant to molten cryolite and electrically conductive.

9. The cell of claim 1, wherein the cell bottom (30) is made of carbon or a carbon-based material, having a surface layer (31) of electrically-conductive RHM-containing material on which the grid assemblies stand.

10. The cell of claim 1, wherein the walls (11, 12) of the grid assemblies (10) are vertical to the plane of the assembly base.

11. The cell of claim 1, wherein at least some walls of the grid assemblies (10) are inclined by an angle up to 15° to vertical from the plane of the assembly base.

12. The cell of claim 1, wherein the grid assemblies (10) are formed by a series of plates (11, 12) intersecting one another, preferably at right angles, the intersecting plates defining a series of generally vertical openings (13) through the grid assembly.

13. The cell of claim 12, wherein the plates (11,12) have end parts (16, 17) protruding from the outer faces of the two outermost plates with which they intersect.

14. The cell of claim 1, wherein the grid assemblies (10) are formed by tubular pieces (50) joined together side-by-side.

15. The cell of claim 14, wherein the tubular pieces (50) define the series of generally vertical through-openings (13) of the grid assembly, said openings being provided inside the tubular pieces and between the tubular pieces.

16. The cell of claim 1, wherein the grid assemblies are formed by profiled sections assembled side-by-side to define the series of generally vertical through-openings in the grid assembly.

17. The cell of claim 1, wherein the grid assemblies are formed by a series of plates held in spaced-apart parallel configuration by transverse securing members.

18. The cell according to claim 1, wherein the bottom ends of the walls (11, 12) are spaced above the cell bottom or have apertures (14) allowing passage of molten aluminium on the cell bottom within the lower end part of the grid assembly (10) between the bottom parts of the walls forming the grid assembly.

19. The cell of claim 1, wherein the top parts of at least some of the walls (16) of the grid assembly (10) have recesses (65) serving as guides which receive the lower ends of anode plates (74) suspended above the grid assembly.

20. The cell of claim 19, wherein other walls (62) of the grid assembly intersecting with said recessed walls (61), and which are made of electrically-conductive material, protrude above the molten product aluminium (72).

21. The cell of claim 20, wherein the parts of said walls (62) protruding above the molten product aluminium (72) are made of or coated with aluminium-wettable material.

22. A method for the production of aluminium by the electrolysis of a molten electrolyte, in particular the electrolysis of alumina dissolved in a fluoride-based molten halide electrolyte, comprising the steps of:

utilizing an electrolysis cell comprising a plurality of anodes (34) immersed in the molten electrolyte above a cell bottom (30, 66) wherein molten product aluminium is collected in a pool or layer (32, 72) containing bodies of aluminium-resistant material, wherein the anodes (34) are associated with a number of corresponding bodies each formed by a grid assembly (10) of side-by-side upright or inclined walls (11, 12; 21, 22; 41, 42; 51; 6, 62) made of or coated with aluminium-resistant material, the walls of each grid assembly having top ends placed under the anode (34) and bottom ends standing on the cell bottom (30,66) covered by the pool or layer (32, 72) of molten aluminium, the bottom ends of the walls forming a base which is large compared to the height of the walls, each grid assembly (10) standing on the cell bottom (30, 66) in stable manner during operation of the cell and being removable from the cell and insertable in the cell, and each grid assembly (10) having generally vertical through-openings (13) dimensioned to allow the molten cell content to occupy the inside of the through-openings, said vertical through-openings (13) being in communication with the molten aluminium in the pool or layer (32, 72) so that the molten aluminium occupies at least a part of the height of said openings (13); and electrolyzing said molten electrolyte in said cell to produce aluminium.

23. The method of claim 22, wherein, during operation, the grid assemblies (10) are removed from the cell periodically or when necessary for servicing or replacement, and new or serviced grid assemblies are replaced in the cell.

* * * * *